US008474393B1

(12) United States Patent
Chandler

(10) Patent No.: US 8,474,393 B1
(45) Date of Patent: Jul. 2, 2013

(54) SECTIONAL BOAT

(76) Inventor: Walker Chandler, Molena, GA (US)

( * ) Notice: Subject to any disclaimer, the term of this patent is extended or adjusted under 35 U.S.C. 154(b) by 372 days.

(21) Appl. No.: 12/925,676

(22) Filed: Oct. 27, 2010

(51) Int. Cl.
*B63B 7/04* (2006.01)
*B63B 3/08* (2006.01)

(52) U.S. Cl.
USPC ..... 114/352; 114/77 R

(58) Field of Classification Search
USPC ..... 114/77 R, 77 A, 352–354
See application file for complete search history.

(56) References Cited

U.S. PATENT DOCUMENTS

| | | | | |
|---|---|---|---|---|
| 45,039 | A | 11/1864 | Heath | |
| 257,591 | A | 5/1882 | King | |
| 520,823 | A | 6/1894 | Heimbaugh | |
| 697,539 | A | 4/1902 | Pruden | |
| 727,894 | A | 5/1908 | Burton | |
| 957,820 | A | 5/1910 | Vaniman | |
| 1,038,676 | A * | 9/1912 | Stevens | 114/250 |
| 1,148,961 | A | 8/1915 | Ellison | |
| 1,259,860 | A * | 3/1918 | Haussler | 114/77 R |
| 1,400,787 | A * | 12/1921 | Baer | 114/77 R |
| 1,445,792 | A | 2/1923 | Olson | |
| 1,499,686 | A * | 7/1924 | Northrup | 114/251 |
| 1,575,982 | A | 3/1926 | Ferris | |
| 1,891,602 | A | 7/1930 | Neil | |
| 1,901,545 | A | 3/1933 | Wood | |
| 1,948,831 | A | 2/1934 | Sobieralski | |
| 2,040,373 | A | 5/1936 | Green | |
| 2,441,999 | A | 5/1948 | Fluke | |
| 2,569,611 | A | 10/1951 | Jenkins | |
| 2,650,376 | A | 9/1953 | Sommer | |
| 2,659,464 | A | 11/1953 | Sweetman | |
| 2,549,412 | A | 4/1954 | Bergman | |
| 2,794,992 | A | 6/1957 | Metzing | |
| 2,977,607 | A | 5/1961 | Roblee | |
| 3,081,465 | A | 3/1963 | Billmeyer | |
| 3,109,406 | A * | 11/1963 | Stockdale | 114/251 |
| 3,111,691 | A | 11/1963 | Luger | |
| 3,121,238 | A | 2/1964 | Levenson | |
| 3,266,067 | A | 8/1966 | Windel | |
| 3,400,414 | A | 9/1968 | Windel | |
| 3,744,071 | A | 7/1973 | Bossler | |
| 3,822,427 | A | 7/1974 | Ewart, Jr. | |
| 3,965,513 | A | 6/1976 | Horiuchi | |
| 3,996,634 | A | 12/1976 | Grind | |
| 4,052,761 | A | 10/1977 | Rilling | |
| 4,366,769 | A | 1/1983 | Lingeman | |
| 4,445,244 | A | 5/1984 | Wilce | |
| 4,459,714 | A * | 7/1984 | Lin | 5/655.3 |
| 4,478,167 | A | 10/1984 | Hart | |
| 4,574,725 | A | 3/1986 | Dowd | |
| 4,779,556 | A | 10/1988 | Smith | |
| 4,827,865 | A | 5/1989 | Yelderman | |
| 4,919,632 | A | 4/1990 | Smith | |

(Continued)

FOREIGN PATENT DOCUMENTS

| | | | |
|---|---|---|---|
| DE | 29706165 U1 | * | 7/1997 |
| GB | 407491 A | * | 3/1934 |
| GB | 516835 A | * | 1/1940 |
| GB | 671976 A | * | 5/1952 |

*Primary Examiner* — Ajay Vasudeva

(57) ABSTRACT

A sectional boat has a plurality of independently floating sections, each section having an outwardly projecting bulge on the port and starboard sides. A peripheral channel extends on an external surface of each bulge to accommodate a connecting member, which exerts tension to align the floating sections and form a single buoyant hull.

14 Claims, 6 Drawing Sheets

U.S. PATENT DOCUMENTS 6,325,013 B1 12/2001 Brown
6,325,014 B1 12/2001 Blanchard
6,619,224 B1 9/2003 Syfritt
6,637,362 B1 10/2003 Avidiya

* cited by examiner

SECTIONAL BOAT

CROSS-REFERENCE TO RELATED APPLICATIONS (IF APPLICABLE)

None

FEDERALLY SPONSORED RESEARCH

None

SEQUENCE LISTING OR PROGRAM (IF APPLICABLE)

None.

BACKGROUND OF THE INVENTION

1. Field of the Invention

This invention relates generally to boats made in discrete sections and the means whereby various sections of all different sorts are joined together.

2. Prior Art

The following is a tabulation of some prior art that presently appears relevant:

U.S. patents

| Pat. No. | Kind Code | Issue Date | Patentee |
|---|---|---|---|
| 957,820 | | May 10, 1910 | Vaniman |
| 1,148,961 | | Aug. 3, 1915 | Ellison |
| 2,569,611 | | Oct. 2, 1951 | Jenkins |
| 3,744,071 | 9/2 S | Jul. 10, 1973 | Bossier |
| 4,366,769 | 114/352 | Jan. 4, 1983 | Lingeman |
| 4,052,761 | 9/2 S | Oct. 11, 1977 | Rilling |
| 3,266,067 | 9/2 | Jun. 16, 1965 | Windel |
| 3,822,427 | 9/2 S; 114/77R | Jul. 9, 1974 | Ewart, Jr. |
| 4,478,167 | 114/352 | Oct. 23, 1984 | Hart |
| 4,779,556 | 114/352 | Oct. 25, 1988 | Smith |
| 4,827,865 | 114/353, 114/356 | May 9, 1989 | Yelderman |
| 6,325,013 | 114/352, 114/357 | Dec. 4, 2001 | Brown |
| 6,637,362 | 114/352 | Oct. 28, 2003 | Avidiya |

The concept of building sectional boats is not new. The concept of building separate bows, sterns, and midsections has existed since ancient times. Inventors and creators have addressed issues such as water-tightness, ridgidity, strength, flexibility, means of joining sections, and configurations and designs thereof to deal with the numerous problems inherent in boat design As a result, workers in the art have designed sectional boats to overcome such problems. Examples of sectional boats can be found in U.S. Pat. Nos. 957,820 (hereinafter "820"), 6,325,013 (hereinafter "013"), 6,637,362 (hereinafter "362"), 4,478,167 (hereinafter "167"), 1,148,961 (hereinafter "961") and 3,266,067 (hereinafter "067"). All prior inventions of prior art have involved joining of proposed discrete sections using mechanical connections such as specialized clamps (961 and 167), studs (362 and 820) or overlaps (067 and 013) and combinations thereof. The disadvantages of such previous systems are:

(a) They rely upon complex interdependent parts and do not lend themselves to wide variations of uses outside of the basic revealed embodiments.

(b) They employ methods for joining sections that do not sufficiently allow for the relieving of the stresses of travel over water through adequate provisions for flexion or rely on stiffening systems which put undue compressive or twisting stresses at critical spots between sections during flexion.

(c) Although some reveal designs for standing sections on end and for nesting of sections with a view toward economy of storage, no previous boats reveal the multiplicity of fabrications and combinations available using the system I have invented.

SUMMARY

In accordance with one embodiment, a simple boat is assembled from a bow, a middle section, and a stern, all of which are or can be secured together without the use of holes or openings below the waterlines that could allow flooding of the various sections. Its gunnels and decks are uniformly flat and are provided with uniform systems of predetermined, spaced bolt holes for securing sections together as well as for the attachment of accessories. All sections assembled in line are united on each side with a single tensionable outboard strap or rope that rests in roads made over and under the bulge that extends along each side of the assembled hull suctions.

ADVANTAGES

The sectional boat system presented is to small boats as the common pick-up truck is to motor vehicles and just as potentially versatile Its uses are limited only by the imagination. In its simplest embodiment as a flat water cruising boat, it provides a craft that can be motored, sailed, paddled or rowed, taken to and from water by common utility trailers, stored on end indoors, fitted with tents, sunroofs and mosquito netting, and have an independent fishing positioning or gear storage station in the cockpit bow. The division of sections as well as the raised floors help provide dryness and comfort where desired. The ample stern provides a transom for the mounting of a motor or rudder and ample room for the storage of fuel, batteries, portable toilets and the like.

In more complex embodiments illustrated herein expressly and by implication and extensions of the teachings revealed, an array of embodiments can be fashioned from the basic sections and logical furtherances thereof. Such embodiments would include barges, pontoons for bridges, mobile floating deck assemblies, recreational and humanitarian long-distance craft, and camping craft.

DRAWINGS

Figures

An understanding of the detailed description of the preferred embodiments can be enhanced by referring to the drawings in which.

Figure 3:
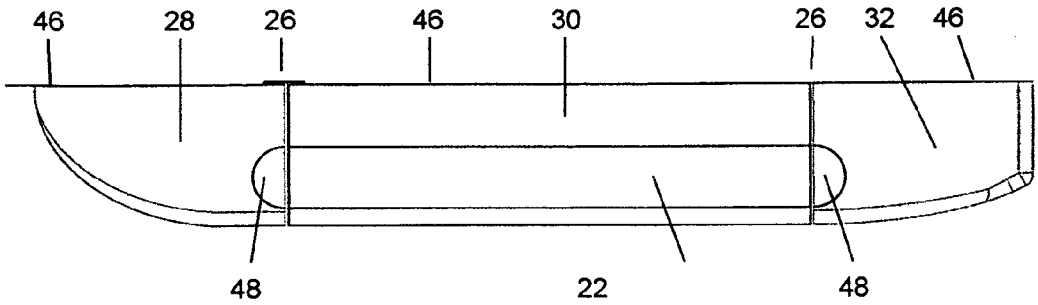

FIG. 3. shows a side view of a basic embodiment wherein a bow, a middle section, and a stern are aligned prior to joining.

Figure 2:
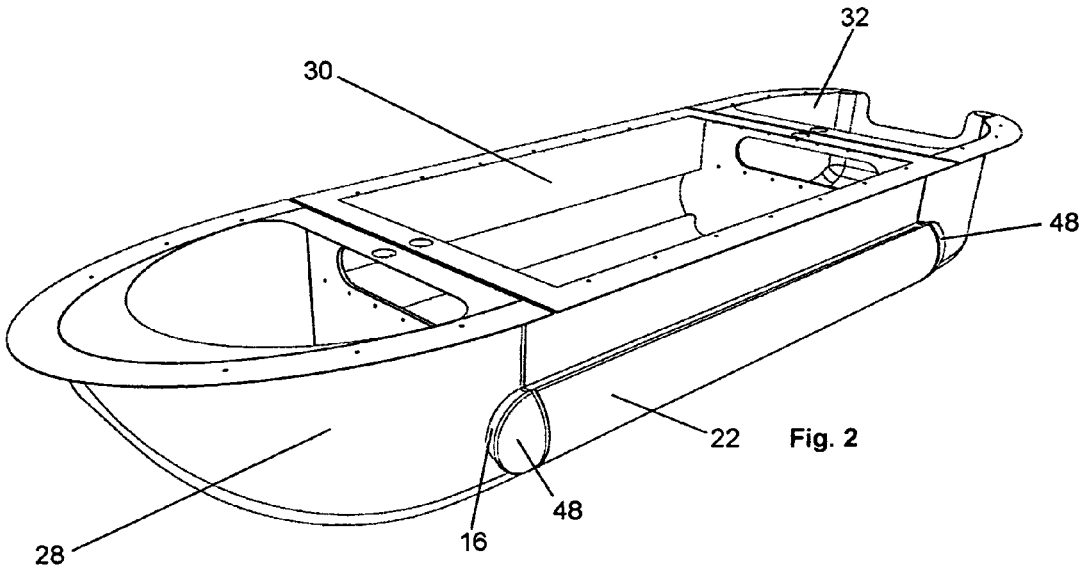
FIG. 2 shows a perspective view of one embodiment in which a bow, middle section, and stern are aligned.
Figure 4:
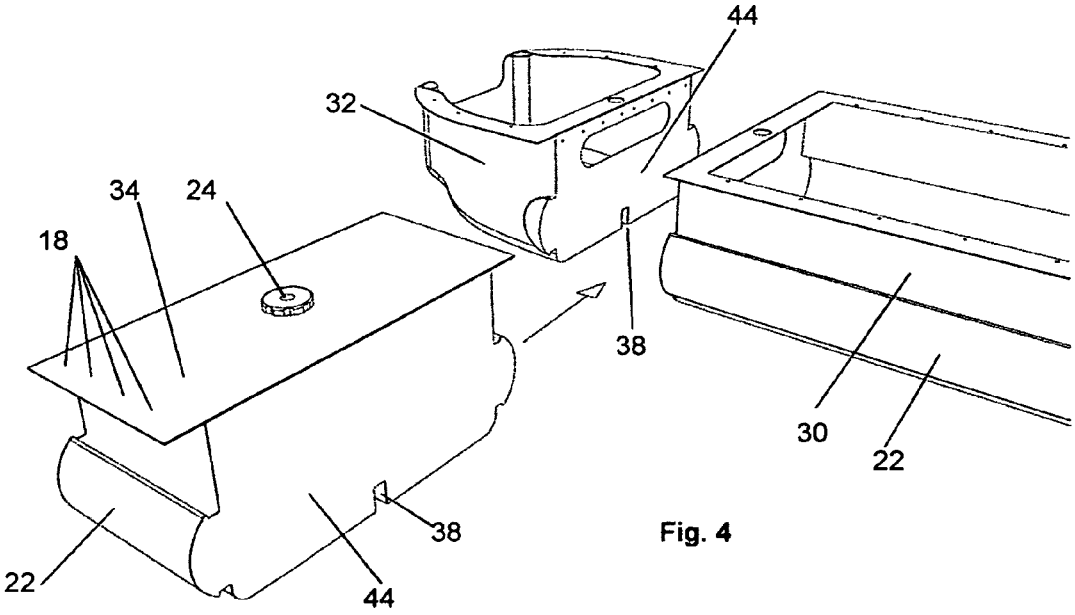

FIG. 4 shows, in perspective, an embodiment in which is shown a closed fuel tank prior to its insertion into a boat configuration similar to FIG. 2.

Figure 5:
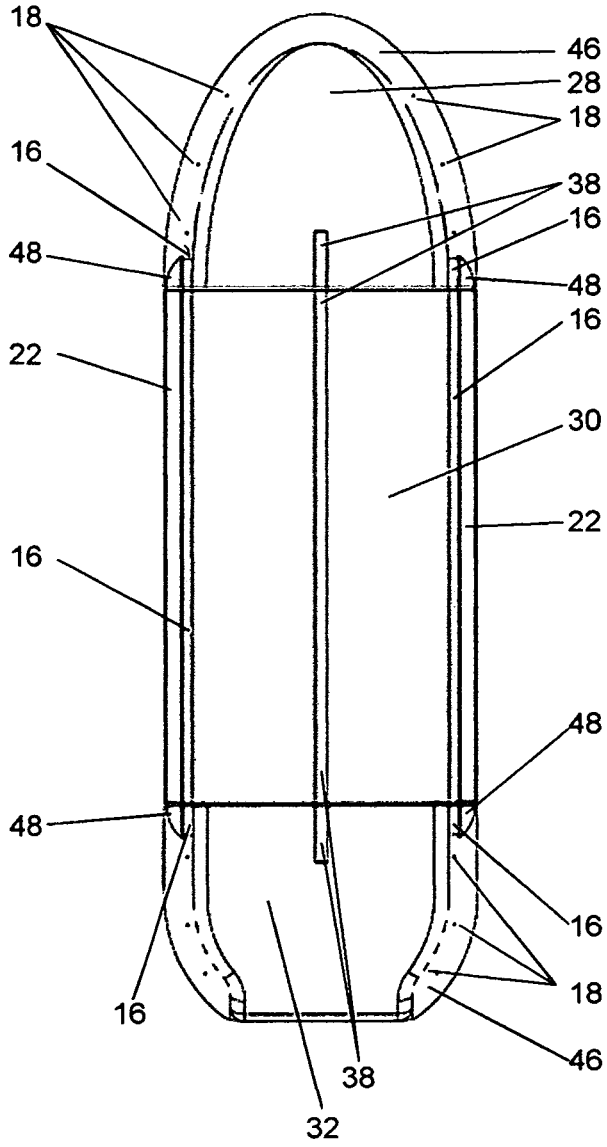

FIG. 5 illustrates the bottoms of three aligned sections.

Figure 6:
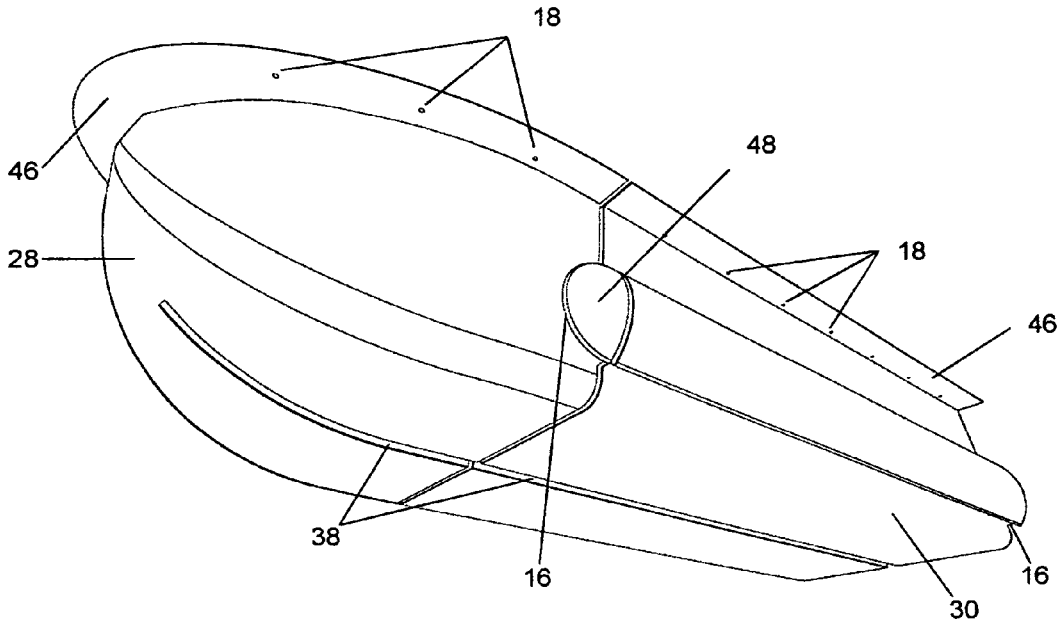

FIG. 6 illustrates in perspective the sides and bottoms of an aligned bow and middle section.

Figure 7:
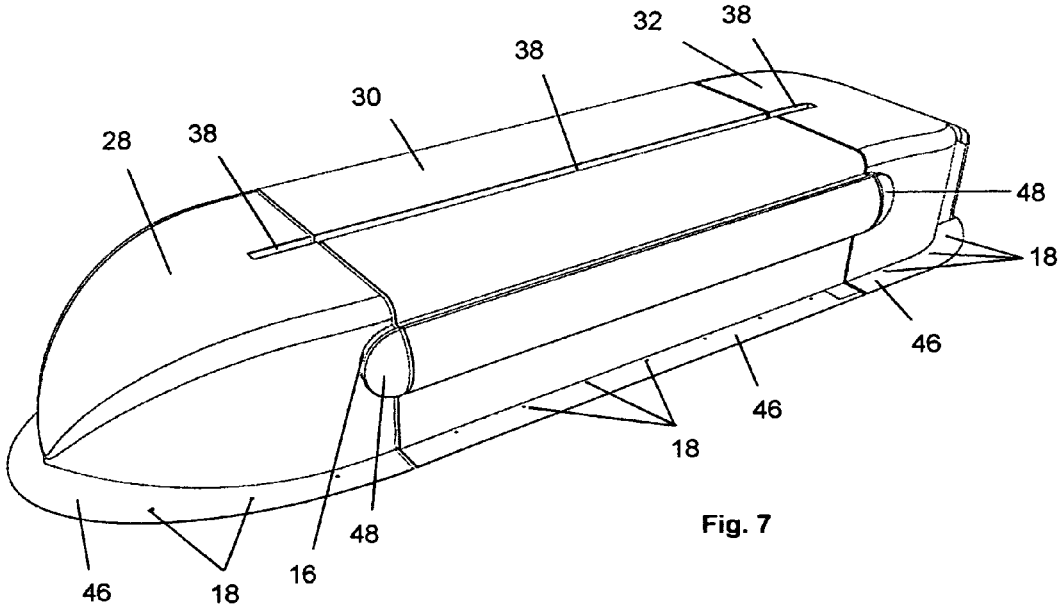

FIG. 7 illustrates a perspective view of an alignment of an inverted bow, middle section, and stern.

Figure 8:
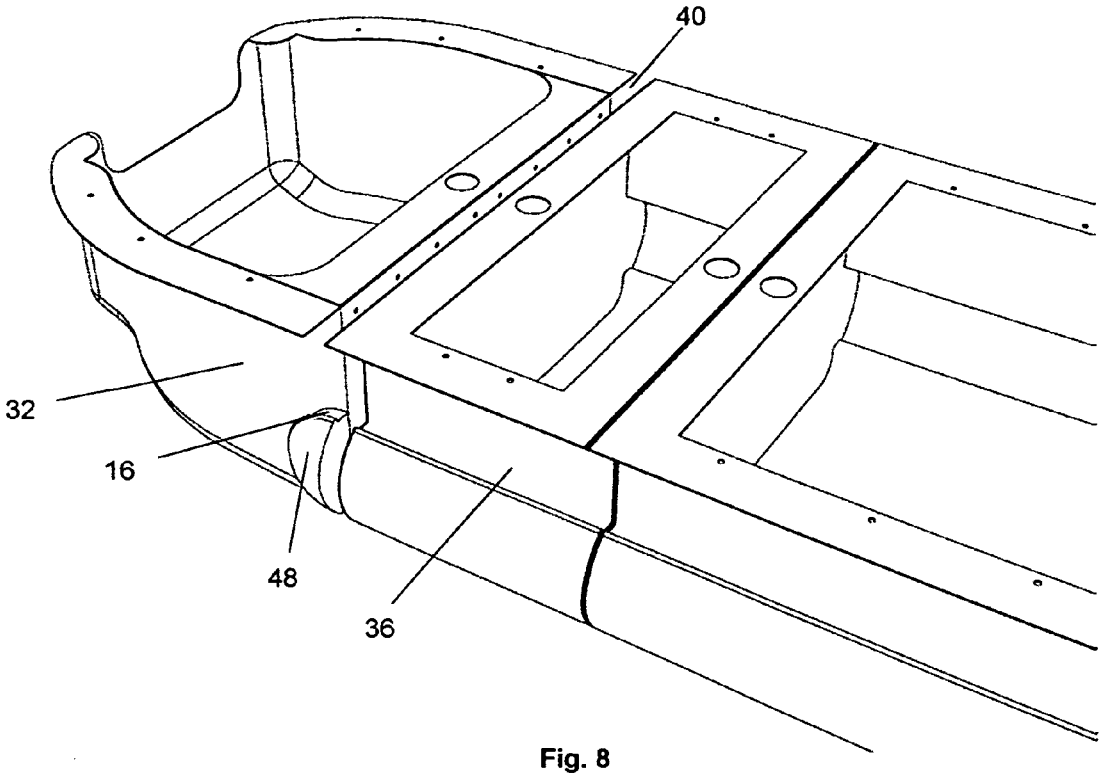

FIG. 8 illustrates in perspective an embodiment wherein an open-topped fish keeping tank or storage bin is aligned immediately forward of a stern section.

Figure 9:
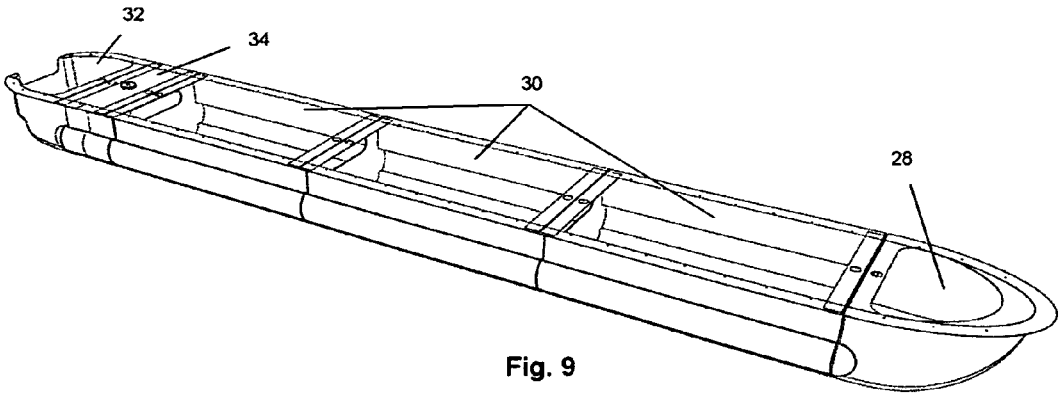

FIG. 9 illustrates in perspective an embodiment wherein a bow, three midsections, a fuel tank and a stern have been joined together.

Figure 10:
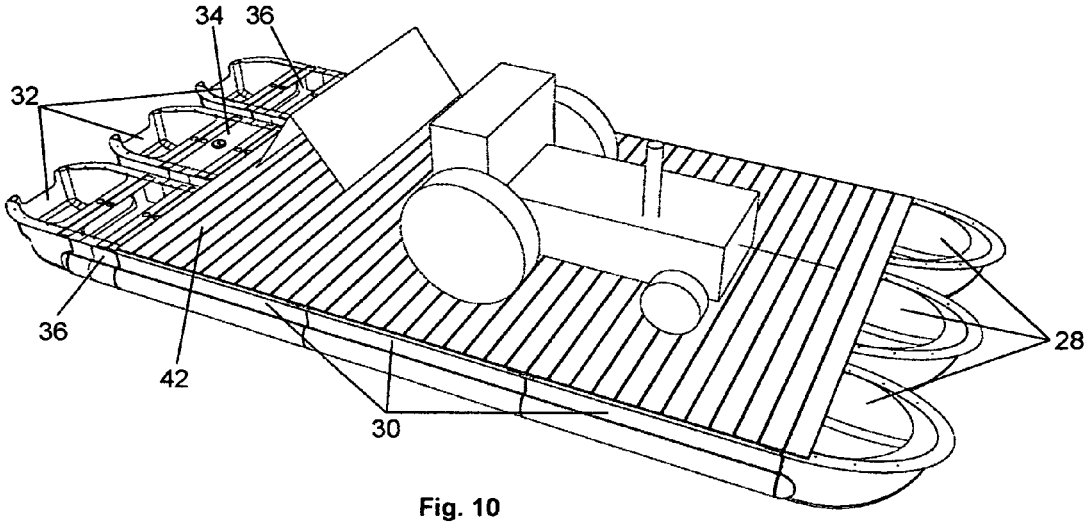

FIG. 10 shows in perspective from off and above the starboard quarter an embodiment wherein three long individual multiple section configurations of the type show in FIG. 9 have been united with decking.

Figure 11:
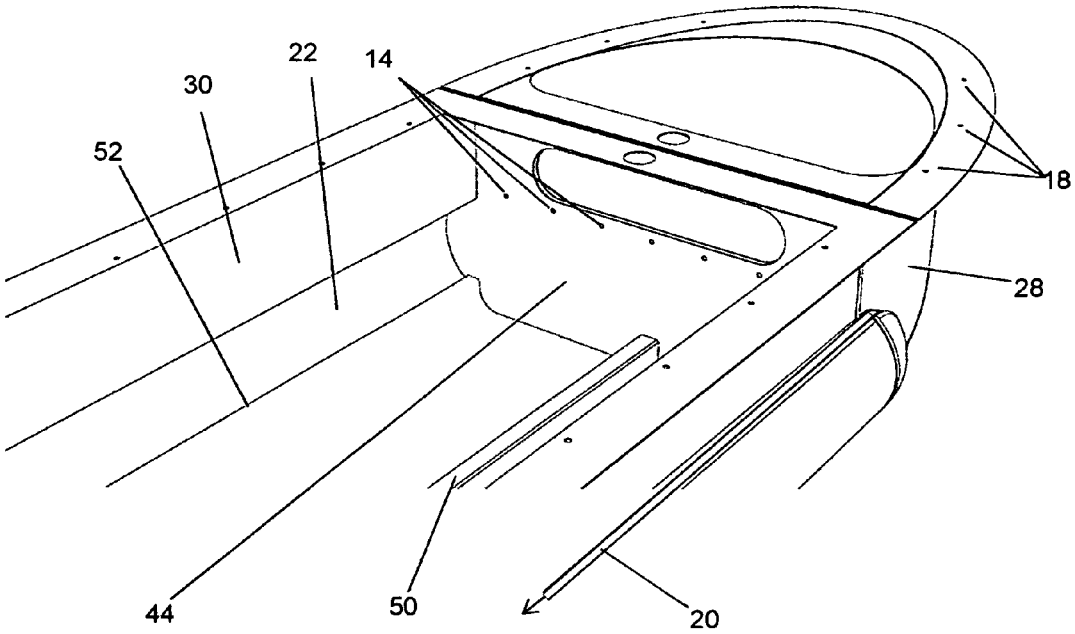

FIG. 11 show in perspective a view into a part of the interior of a middle section and bow that are joined.

Reference Numerals

| | | | |
|---|---|---|---|
| 14 | longitudinal bulkhead bolt hole | 16 | road or notch |
| 18 | vertical gunwale bolt hole | 20 | band, strap or rope |
| 22 | outward projection | 24 | screw cap |
| 26 | hinge or plate | 28 | bow |
| 30 | standard boat middle section | 32 | stern |
| 34 | fuel tank section | 36 | ice chest/fish tank/storage section |
| 38 | bottom notch or stiffening slot | 40 | space or gap |
| 42 | decking | 44 | bulkhead |
| 46 | gunnel | 48 | rounded outward projection end |
| 50 | interior top of stiffening slot | 52 | inside top of lower road |

DETAILED DESCRIPTION OF THE DRAWINGS

Figure 1:
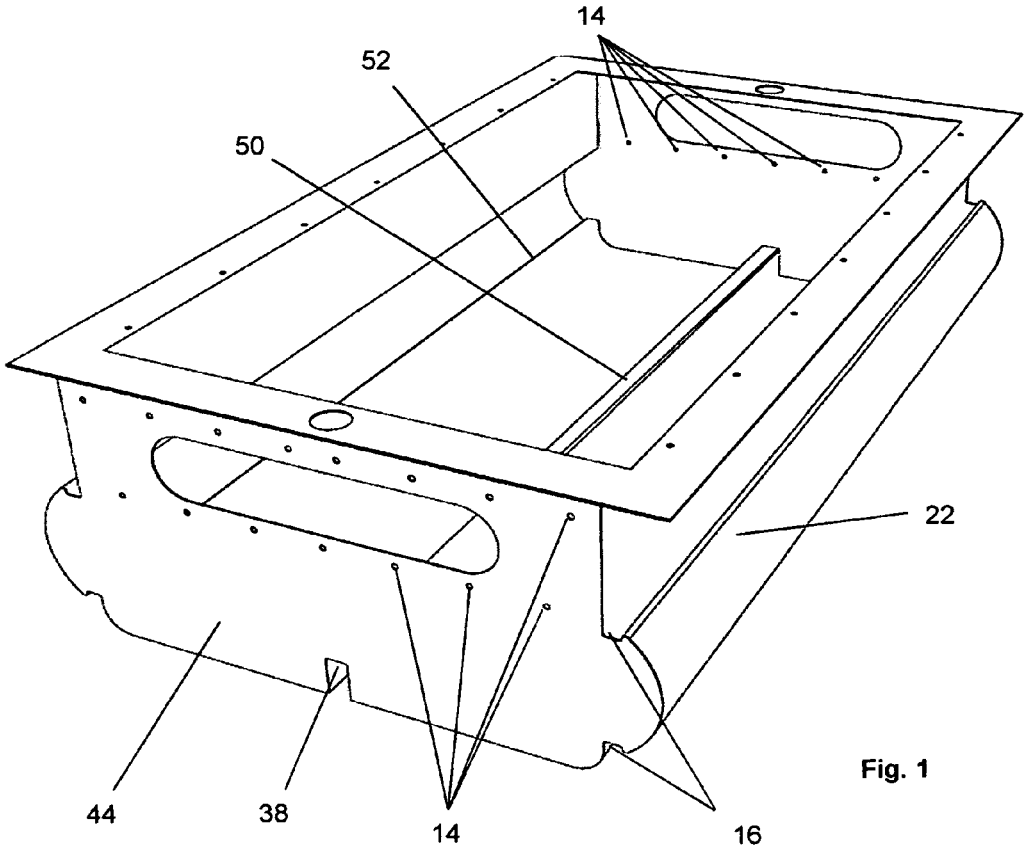
FIG. 1 shows a perspective view of a middle section.

FIG. 1 illustrates in perspective a middle section 30. The vertical transverse bulkhead 44 used at the adjacent ends of joined sections is shown. Such bulkhead serves as pattern for any flexible gaskets to be placed between joined sections and as a pattern for the bottom ends of sheets of thin materials such as Plexiglas and plywood that may also be sandwiched between adjacent, joined sections.

Shown as details on FIG. 1 are bolt holes 14 through the bulkhead above design waterlines, bulges 22, roads 16 whereon common tensionable bands, straps or ropes may be fitted. Such bands, straps or ropes provide a system of tightening and holding straps above and below the bulges that form the widest parts of the beams of configured boats.

FIG. 1 also shows the provision in each bulkhead for the use of a bottom notch 38 which is where longitudinal keels and stiffeners can be fitted. Keels of wood or metal can be used that are either flush with the rest of the bottom of the boat, or may extend downward farther to provide resistance to yawing or stewing when the boat is moving. Inserted keels can also be used to add to the longitudinal compressive securing of assembled craft by extending tightened straps from such keels fore and aft.

FIG. 1 also illustrates that the inside top of the slot 38 is level with the tops of the bottom roads on either side of the bulkhead so that a floor may be fitted into the boat and rest upon the aforesaid inner road tops and the top of the notch or notches. Flotation foam can be fitted in beneath any such floors.

FIG. 2 illustrates a basic embodiment where a bow 28, a middle section 30, and a stern 32 are aligned. It illustrates how the ends of the system of bulges 22 used on other boat sections terminate in a round configuration 48, with roads that allows bands 20, straps or ropes to run both under and over the bulges 22 on either side of the boat.

FIG. 3 illustrates, in side view, a simple boat structure in accordance with a basic embodiment wherein a bow 28, a central section 30, and a stern 32 are joined together. They are held together at each topside meeting of gunnels 46 by hinges or plates 26. An adjustable strap or rope that can be tightened by a ratchet or other means is put in the roads 16 on and under the bulges 22 and before being tightened to hold the three sections of this embodiment together.

FIG. 4 illustrates in perspective an embodiment in which is shown a closed fuel tank 34 prior to its insertion into a boat configuration similar to the one shown in FIG. 3. The bulkhead 44 illustrated is solid but follows the basic pattern of using the general common bulkhead design shown in FIG. 1. The illustrated tank has a cap 24.

FIG. 5 illustrates in perspective the underside of the embodiment wherein three sections as shown in FIG. 3 are aligned. It displays the longitudinal stiffening slots 38 provided in each section wherein a wooden or metal board or shaft may be fitted to serve as keel and to strengthen the boat. FIG. 5 also illustrates how the roads 16 on the bulges 22 continue around the rounded end bulges 48 of the bow 28 and the stern 32 to provide a secure slot or road for the tightening ropes or straps that are used as in the system of joining sections. Also illustrated are predetermined vertical bolt holes 18 in the gunnels 46.

FIG. 6 illustrates in perspective the undersides of a bow 28 and a middle section 30 that are in alignment. The bottom stiffening slots 38 on both sections are shown as well as the front port side rounded bulge 48, with strap road 16. Also illustrated by FIG. 6 is an underside, outboard view of the system of predetermined, spaced bolt holes 18 provided in the gunnels 46 of all sections.

FIG. 7 illustrates a perspective view of the bottom and starboard outboard sides of an embodiment as shown in FIG. 2. Illustrated are an alignment of a bow 28, a middle section 30, and a stern 32. The bottom stiffening slots 38 on all three sections are shown. The front starboard rounded bulge 48, with strap road 16 is shown. The rear starboard rounded bulge 48 is depicted. Also illustrated is an underside, outboard view of the system of predetermined spaced bolt holes 18 provided in the gunnels 46 of all sections.

FIG. 8 illustrates in perspective an embodiment wherein an open-topped fish keeping tank or storage bin 36 has been inserted immediately forward of a stern section 32. Prior to joining a sound-deadening board or sheet extending upward from the gunnels and could be placed in the gap 40 to lessen noise from an outboard motor. Holes for masts, tent poles or other accessories are provided 34. The starboard aft rounded bulge end 48 with road 16 is depicted.

FIG. 9 illustrates in perspective an embodiment wherein a bow 28, three midsections 30, a fuel tank 34 and a stern 32 have been joined together.

FIG. 10 shows in perspective from off and above the starboard quarter an embodiment of the invention wherein three long individual multiple section configurations of the type show in FIG. 9 have been united with decking 42 for the purpose of conveying heavy machinery, forming a section of a pontoon bridge or providing a platform for a movable hospital tent or similar use.

FIG. 11 show in perspective and from above a view into a middle section 30 toward the inside of the port quarter illustrating the inside view of a bulge 22 demonstrating how the inside of the bottom road 16 of the bulge is level with the top of the longitudinal stiffening slot 28 so that flotation can be inserted and a floor may be set atop the topsides of the raised road interiors 16 and stiffening slot 28. Also shown are the system of holes 18 in the gunnels as well as those bolt holes 14 in the bulkhead 44. A band or strap 20 is set in the starboard roads.

Accordingly the reader will see that, according to one embodiment shown in FIG. 3 I have provided a simple, foldable, sectional boat that can be motor-powered, sailed, rowed or paddled. All manner of accessories including tents, mosquito netting, sails, lee boards, extra thwarts and seats, deck covers, and bowsprits can be affixed using the systems of predetermined holes.

In an embodiment illustrated by FIG. 9 a bow 28 and stern 32 have aligned between them three middle sections 30 and a fuel tank 34 to make a long-distance barge.

In various embodiments exemplified by FIG. 10, configurations of a wide variety of floating tools and applications that can be assembled from lightweight sections that can be delivered in large quantities by air drops over water without parachutes. Sections may then be assembled by untrained crews into pontoon bridges, relief supply barges, floating decks for the shipment of machinery or as mobile bases for hospital and housing tents, as well as other mobile, floating systems.

From the depictions of embodiments and depictions of sections illustrated by FIGS. 1, 2, 3, 4, 6, 7, 8, 9, 10, and 11, it will be seen that in any given initial assembly of sections, there is no provision along gunnels or otherwise for that boat design characteristic known as sheer. Therefore in any initial assembly of sections, the topsides of all gunnels would theoretically be in the same level plane.

While the above description contains many specifications, these should not be construed as limitations on the scope of any embodiment, but as exemplifications of various embodiments thereof. Many other ramifications and variations are possible within the teachings of the various embodiments.

Thus the scope should be determined by the appended claims and their legal equivalents, and not by the examples given.

Advantages

From the descriptions above, a number of advantages of some of the embodiments of my sectional boat system become evident:

(a) All sections are made to join easily. All bolts that are used could employ wing nuts so that no specialized tools or skills would be need for any envisioned assembly of boats or attachments of accessories.

(b) In the said three section simple embodiment, the boat presented can be seen to be satisfactory for expeditions on flat water, including expeditions to areas where biting insects make camping intolerable. With the insertion of another middle section, fuel tank or open storage sections as show in the drawings, truly long distance expeditions could be mounted.

(c) Bows are seen to have open cockpits. By the use of kayak style lips on the edges of the openings, impermeable deck covers can be fitted. Pets such as hunting dogs and guard dogs can be made to ride in such bow sections, thereby being near to but isolated from their owners.

(d) Another advantage of the system I present is the use between each of the unions of sections sheets of some pliable material such as semi-rigid common sheet Styrofoam used as wall insulation cut to the pattern of the common bulkhead embodied and presented herein can be inserted. Such possibly homemade gaskets can seal the undersides of the boat and prevent splashing of water up through the narrow confines of the places where bulkheads are joined. Such materials can also be used to provide some flexibility from the shocks inherent in wave action and the passage of the boat through the water. Between two such gaskets other materials such as sheets of Plexiglas or plywood cut to the patterns of the universal bulkhead below the line of the gunnels but extended upward above such lines can be inserted so as to provide windshields as well as walls for security, privacy and dampening of the sounds emanating from outboard motors mounted on the stern.

(e) The horizontal bulkhead bolt holes of the embodiment can be used for joining sections and holding gaskets in place prior to joining. The holes can also be used for the passages of motor control lines, steering tackle, and electrical lines.

(f) The slots provided in the bottoms of each section can be used for the employment of long boards such as common 2 by 4s, to stiffen the sections longitudinally, provide links between sections, and provide for a place or method below the water for the attachment of accessories such as thin metal keels to allay yawing or the tendency of the craft to slide leeward during sailing. Such long boards can be held in place at their ends and wherever they pass a bulkhead junction between joined sections.

(g) The inside tops of the stiffening slots being made level with the inside tops of the lower roads on either side, plywood decks can be laid in the boats using such tops as longitudinal joists. Large amounts of block Styrofoam floatation can be neatly set in the below-deck voids as further support for the decks.

(h) The middle sections can be made long enough and wide enough so that two people can lie down on an installed flat deck in comfort, thereby making the boat suitable for camping. The use of flat, unobstructed floors that can be used with any variety of folding cots, chairs, wheelchairs, equipment and supplies that might suggest themselves to inventive minds.

(i) The width of the beam at the widest point of the bulges can be made to be less than the width of common utility trailers, thereby eliminating the necessity to employ special boat trailers. The flat bottoms of sections eliminate the need to have special cradles for holding sections during transport.

(j) The tendency of flat bottom boats to yaw or be pushed leeward can be overcome, if desired, through the use of deeper keels, leeboards and the like.

(k) The system of predetermined gunnel holes can likewise be used not only to attach chair rails, plates or hinges at areas where bulkheads are joined, but also to provide attachment places for tarps, tents, oar locks, lee boards, fishing gear, thwarts, sailing tackle, landing planks, bowsprits, and the like.

(l) The system of using common, tightenable straps or ropes around the bulges on the outer, weather sides of the hull is the most unique aspect of the embodiment. Such straps may be joined to one another to provide for very long configurations. In the event of a strap being broken or cut, rope, wire or other materials could be used for emergency repairs.

(m) The use of the rounded bulge ends on bows and sterns allows the straps to be put on below the bulges and brought around the ends to meet at ratchet devices on the top sides of the bulges. Simultaneously tightening the straps on either side of the boat compresses the bulkheads against one another and against any pliable gaskets that have been placed between such converging bulkheads. The system of roads or slots above and below the bulges act as guides to prevent the straps from popping off outward during tightening and use. The areas on the outside of the hulls above the roads and below the gunnels, being above the waterlines, can be used as places to secure poles and oars alongside.

(n) Embodiments joined side by side in parallel configurations can be decked over for the purpose of transporting machinery, as floating platforms for emergency field hospitals and the like, or for use as bridge pontoons.

(o) The use of flat horizontal gunnels on all sections of the embodiment facilitate folding embodiments on to adjacent sections and stacking sections atop one another. The use of such gunnels facilitates decking parallel configurations of the embodiment. The use of such gunnels facilitates transporting sections of the embodiment on flatbed trucks and trailers. The use of such gunnels facilitates laying the sections upside down on flat surfaces. The use of such gunnels facilitates joining sections together with plates, rails or hinges attached to the gunnels.

CONCLUSION, RAMIFICATIONS AND SCOPE

Accordingly, an entire boat and pontoon assembly system that provides a wide variety of commercial, humanitarian and recreational opportunities is made possible by the various embodiments.

I claim:

1. A sectional boat having a bow and a stern, comprising:

a plurality of independently floating sections disposed between the bow and the stern, wherein each independently floating section has a complementary shape relative to the adjacent section;

each section comprising substantially vertical port and starboard sides and a substantially planar bottom extending between the port and starboard sides, each section further comprising a bulge disposed on outer surface of the port and starboard sides, said bulge projecting outwardly in a substantial horizontal direction, wherein a peripheral channel is provided on top and bottom external surfaces of each bulge;

a tensionable connecting member extending in fore-and-aft direction on each side of the independently floating sections, each connecting member encircling the outwardly projecting bulges of the floating sections by extending through the respective peripheral channels; said connecting member exerting tension to align the port and starboard sides and the bottoms of the floating sections and tensioning the sections together to form a single buoyant hull, wherein the tensionable connecting member is selected from a group consisting of a rope, a flexible strap and a pliable band.

2. The sectional boat of claim 1, wherein said tensionable connecting member comprises detachably attached ends that are joined by tensioning.

3. The sectional boat of claim 1, wherein each said peripheral channel comprises an open groove.

4. The sectional boat of claim 3, wherein said open grooves of said floating sections have uniform dimension.

5. The sectional boat of claim 1, wherein the adjacent bulges have complementary sizes and shapes to provide a continuous protrusion when the adjacent floating sections are assembled to form the single hull.

6. The sectional boat of claim 1, wherein each section comprises a transverse bulkhead extending between the port and starboard sides, the bulkhead extending substantially vertically from the planar bottom of the floating section.

7. The sectional boat of claim 6, wherein the adjacent bulkheads have aligned apertures disposed above a waterline of the assembled boat, said aligned apertures receiving one or more fasteners to secure the sections together.

8. The sectional boat of claim 7, wherein said fasteners comprise bolts.

9. The sectional boat of claim 7, wherein the adjacent bulkheads are substantially identical in size and shape.

10. The sectional boat of claim 1, wherein each said bottom comprises a watertight cavity extending in fore-and-aft direction, wherein the adjacent cavities are aligned to form a longitudinal slot.

11. The sectional boat of claim 10, wherein said longitudinal slot houses a longitudinal stiffener and/or a keel.

12. The sectional boat of claim 11, wherein the longitudinal stiffener and the keel are made of a material selected from a group consisting of wood and metal.

13. The sectional boat of claim 1, wherein the plurality of floating sections comprises three or more sections.

14. The sectional boat of claim 1, wherein a plurality of sectional boats are assembled together to form a floating platform.

* * * * *